US006001022A

United States Patent [19]

Spieldiener et al.

[11] Patent Number: 6,001,022

[45] Date of Patent: Dec. 14, 1999

[54] AMUSEMENT FACILITY

[76] Inventors: Robert Spieldiener, Joseph-Rheinberger-Str. 18, FL-9490 Vaduz; Reinhold Spieldiener, Aussichtsstrasse 23, CH-8704 Herrliberg; Patrick Spieldiener, Erlenstrasse 134, CH-8942 Wollerau; Alfons Saiko, Speerstrasse 26a, CH-8942 Oberrieden, all of Germany

[21] Appl. No.: 09/157,480

[22] Filed: Sep. 21, 1998

[51] Int. Cl.[6] ..... A63G 31/10

[52] U.S. Cl. ..... 472/131; 472/2; 472/50

[58] Field of Search ..... 472/131, 134, 472/49, 50, 136, 137, 2

[56] References Cited

U.S. PATENT DOCUMENTS

| | | | |
|---|---|---|---|
| 2,229,201 | 1/1941 | Williford et al. . | |
| 5,417,615 | 5/1995 | Beard . | |
| 5,447,211 | 9/1995 | Sors | 472/131 X |
| 5,597,358 | 1/1997 | Marcu | 472/50 |
| 5,632,686 | 5/1997 | Checketts | 472/131 |
| 5,704,841 | 1/1998 | Checketts | 472/131 |

FOREIGN PATENT DOCUMENTS

| | | |
|---|---|---|
| 0 707 875 A1 | 4/1996 | European Pat. Off. . |
| WO 96/32172 | 10/1996 | WIPO . |

*Primary Examiner*—Kien T. Nguyen
*Attorney, Agent, or Firm*—McGlew and Tuttle, P.C.

[57] ABSTRACT

An amusement facility having a frame with a passenger carrier movably mounted on the frame and a drive connected to the passenger carrier for moving the passenger carrier on the frame. The drive includes a cylinder and a piston with a tension member connecting the passenger carrier to the piston. The piston is movable in the cylinder between a top dead center position and a bottom dead center position. Also the cylinder preferably has ends which are closable, and a lateral fluid inlet and outlet for fluid, preferably air, to move the piston in the cylinder. The fluid outlet is positioned between the top dead center position and the bottom dead center position of the piston.

15 Claims, 1 Drawing Sheet

AMUSEMENT FACILITY

FIELD OF THE INVENTION

The present invention pertains to an amusement facility having a frame with a passenger carrier movably mounted on the frame and a drive means connected to the passenger carrier for moving the passenger carrier on the frame. In particular, the drive means is a cylinder/piston arrangement.

BACKGROUND OF THE INVENTION

Such an amusement facility has been known from EP 0 707 875A1. It has an upright or horizontal design, at which one passenger carrier or a plurality of passenger carriers is/are guided longitudinally movably. In addition, the amusement facility has a drive with a cable cylinder, which is operated by means of compressed air. The compressed air is guided via controllable inlets and outlets. The piston, which can be moved to and fro in the cylinder, is connected to the passenger carrier by a flexible cable. The cylinder is open on the underside in the prior-art arrangement, and the piston is also connected to the passenger carrier on one side only via the cable. As a result, the downward movements of the passenger carrier are brought about by its own weight or its mass inertia only. In addition, the compressed air outlet is located at the top end of the cylinder next to the inlet. The compressed air outlet is designed as a controllable valve. Because of the large volume of air, the valve has a correspondingly large diameter, which may lead to problems in terms of safety of operation during the operation. Complete closing of the outlet valve is not always guaranteed. The passenger carrier may fall in the case of failure of the valve.

An eddy current brake acting as a service brake for a fall frame has been known from WO 96/32172. In the case of this fall frame, the passenger carriers are pulled up by means of a winch, released at the top end of the tower and let fall by free fall. The passenger carriers are braked softly and vigorously at the foot of the fall frame by the eddy current brake. A simple plunge effect, which is caught by the eddy current brake only, is present in this fall frame. A bunjee effect is sought to be achieved by means of the cylinder arrangement and the compressed air in the state of the art described in the introduction. The passenger carrier shall swing up and down several times, as if on rubber cables, by means of the cylinder and the compressed air control.

SUMMARY AND OBJECTS OF THE INVENTION

The object of the present invention is to show a better amusement facility with a bunjee effect.

The present invention accomplishes this object with a passenger carrier movably mounted on the frame and with a drive means connected to the passenger carrier for moving the passenger carrier on the frame. The drive means includes a cylinder and a piston with a tension member connecting the passenger carrier to the piston. The piston is movable in the cylinder between a top dead center position and a bottom dead center position. Also the cylinder preferably has ends which are closable, and a lateral fluid inlet and outlet for fluid, preferably air, to move the piston in the cylinder. The fluid outlet is positioned between the top dead center position and the bottom dead center position of the piston.

The lateral fluid or air outlets offer the advantage that a complicated valve control, as is used in the state of the art, is dispensable. Slots in the cylinder jacket suffice in the simplest case. In addition, higher safety of operation can be achieved due to the air outlets being shifted into the middle area of the cylinder between the two end dead centers of the piston. Besides the higher safety, the present invention benefits from a less complicated design and control and lower costs. Economy is substantially increased.

The cylinder arrangement, which can be closed at both ends, offers the advantage that a compressible fluid, preferably compressed air, can be admitted to the piston from both sides. All movements of the passenger carrier can be controlled in a defined manner as a result. This is especially advantageous also with respect to a free fall effect. The piston can be additionally accelerated from its bottom dead center position by compressed air from the opposite side and the piston can accelerate the passenger carrier during its downward movement beyond the force of gravity. Even though this effect can also be achieved in the prior-art amusement facility known from EP 0 707 875A1, throwing of the passenger carrier over the zenith and repositioning of the cable over a second deflecting roller is necessary for this. This repositioning of the cable between the deflecting rollers is hazardous and is not secured. In contrast, the passenger carrier of the present invention always remains exactly guided, and the admission of compressed air is controlled in a controllable manner in the present invention.

The cylinder arrangement according to the present invention preferably has two lateral fluid outlets arranged at axially spaced locations from one another. In conjunction with the metering of the fluid by a pressure generation means, the desired travel effects can be exactly controlled by selecting the arrangement and the size of these outlets. In addition, the cracking noise occurring in the state of the art can be avoided by correspondingly reducing the pressure when the fluid outlets are reached.

By arranging the lateral fluid outlets at spaced locations from the adjacent dead centers of the piston travel, it is ensured that a fluid column, which can be compressed by the penetrating piston and acts as a compressed air cushion, is always present between the outlet and the dead center. This has, on the one hand, safety aspects, and, on the other hand, it supports the desired bunjee effect. Small discharge valves may be present at the end of the cylinder arrangement for the fine control of this bunjee effect.

It is advantageous for the purpose of the best possible controllability of the movements of the passenger carrier for the passenger carrier and the piston to be connected on both sides via an endless, flexible pulling element. This is preferably a cable arrangement consisting of one or more ropes or cables.

The amusement facility according to the present invention preferably has a braking means, which may act as an emergency brake, but also as a service brake, in the foot area of the frame for the passenger carrier. An eddy current brake, which is described in, e.g., WO 96/32172, is preferably used for this purpose. As an emergency brake, the eddy current brake has the advantage that it does not require any control and it does not need to have any driven parts. As a result, it is especially reliable in operation. On the other hand, the eddy current brake can also act as a service brake by offering a certain resistance to the passenger carrier while it is being pulled up, ensuring as a result an improved and more effective pressure buildup in the cylinder arrangement in the manner of a damping. The necessary volumes and flow velocities of the compressible fluid are lower as a result than in the state of the art. It is possible for the cylinder/piston arrangement to build up a large force while the passenger carrier is being held at the bottom by the brake. When the brake releases the passenger carrier, the piston then greatly accelerates towards the outlet. The supplying of fluid and the momentum of the piston and passenger carrier can be coordinated so that the pressure in the cylinder is substantially equal to ambient when the piston reaches the outlet. In this way the loud cracking like noise of escaping high pressure air is avoided. The brake simplifies the design and makes construction less expensive, and it also makes the operation of the facility substantially less expensive. In addition, a cable brake may be arranged at the top end of the cylinder in order to briefly stop the passenger carrier in the zenith and before the free fall to intensify the plunging effect.

Additional advantageous embodiments of the present invention are described in the subclaims.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 1:
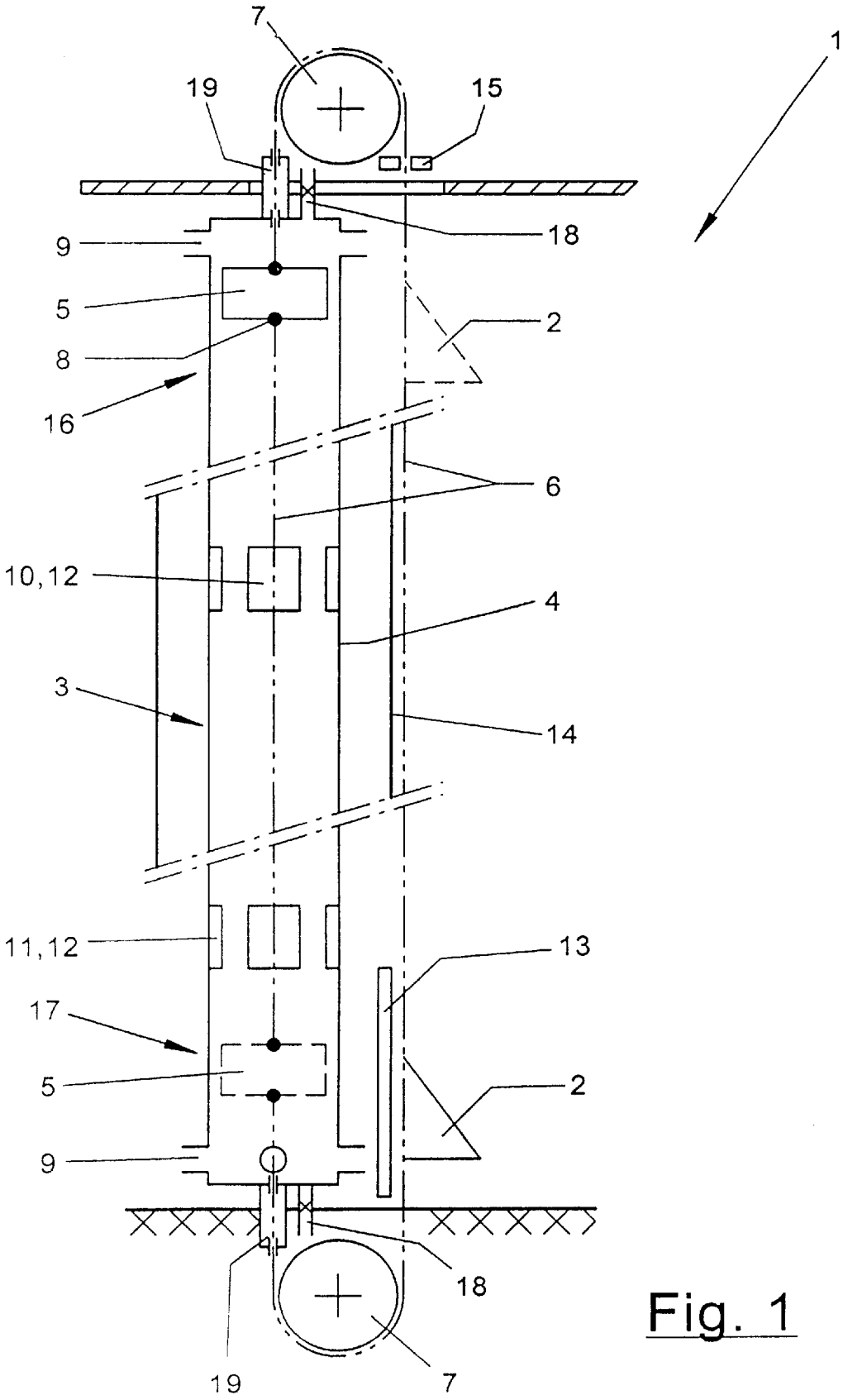
FIG. 1 is a schematic view of an example of the present invention.

It shows an amusement facility 1 with a structure or frame 14, a passenger carrier 2, and a cylinder arrangement 3, which acts as a drive, The embodiment shown is a fall tower. One or more passenger carriers 2 are guided movably up and down the column- or tower-like, upright structure 14 of the fall tower. They are driven by a cylinder arrangement 3, which will be described in greater detail below, by means of a compressible fluid, preferably compressed air. The amusement facility 1 shown generates a bunjee effect in the falling passenger carrier 2, while the passenger carrier 2 swings up and down several times on a compressed air column in the cylinder arrangement 3 and is lowered softly to the ground at the end. In addition, the amusement facility 1 shown makes it possible to achieve a free fall effect, in which the passenger carrier 2 can be accelerated beyond the force of gravity.

In the amusement facility 1 shown, the structure 14 may consist of one or more towers. The passenger carriers 2 are arranged at the structure 14 in any desired manner and are guided longitudinally movably. The cylinder arrangement 3 may have one or more cylinders, which preferably likewise stand vertically. The cylinder arrangement 3 may be arranged inside or outside the structure 14.

A respective piston 5 is movably guided in the cylinder or cylinders 3. The piston 5 is connected on both sides to the passenger carrier or passenger carriers 2 via a flexible and endless pulling or tension element 6. This is preferably a cable arrangement, which consists of one or more ropes or cables. It may be, e.g., an upper cable, one end of which is fastened to the top side of the piston 5 via a cable connection 8, and the other end of which is connected to the top side of the passenger carrier 2. A second, lower cable is then connected via a second cable connection 8 to the underside of the piston 5, and it is connected with its other end to the underside of the passenger carrier 2.

The cylinder or cylinders 3 can be closed at both ends. The pulling element 6 exits both ends via a cable outlet 19 and is then led outside over an upper and lower deflecting roller 7 to the edge of the structure 14 and to the guide for the passenger carriers 2. The cable outlets 19 may also be designed as sound absorbers at the same time.

At the top and bottom ends, the cylinder or cylinders 3 have fluid inlets 9 for the compressible fluid, which is fed in from a reservoir not shown under high pressure. The reservoir, the pressure generators and possibly other accumulators may have any desired design and may have, e.g., the embodiment shown in EP 0 707 875A1. These items are therefore known to those of ordinary skill and do not need to be further described. The fluid inlets 9 are designed as controllable valves, which can be opened and closed. The fluid inlets 9 are always located between the top and bottom dead centers 16, 17 of the piston 5 and the end of the cylinder. They are preferably arranged laterally on the cylinder jacket 4.

One or more small, controllable discharge valves 18 may be located next to the fluid inlets 9 at the upper and lower ends of the cylinder. Relatively small amounts of the compressible fluid can be released via the discharge valves 18, which may also happen for a short period of time or briefly.

The cylinder or cylinders 3 have one or more lateral fluid outlets 10, 11, which are located in the area between the top and bottom dead centers 16, 17 in the cylinder jacket 4. In the embodiment shown, the cylinder 3 has two fluid outlets 10, 11, which are located one on top of another and at spaced locations from one another. The cylinder 3 has a contiguous jacket 4 here, aside from the fluid outlets 10, 11. As an alternative, the cylinder arrangement 3 may also be designed as a divided cylinder arrangement and consist of two cylinder halves arranged at spaced locations from one another. The piston 5 now must be guided in a suitable manner in the free space between the two cylinder halves.

The fluid outlets 10, 11 are preferably designed as slots 12 in the cylinder jacket 4. Axial webs of the cylinder, which can transmit the forces acting in the jacket, are left between the slots 12. The slots 12 are open in the simple embodiment. In another embodiment, not shown, the slots 12 may also have controllable closures, e.g., rotatable or axially adjustable slides. In another variant, the fluid outlets 10, 11 may also be designed as valves, doors or in any other desired and suitable manner.

The fluid outlets 10, 11 are located at differently spaced locations from the adjacent dead centers 16, 17 of the piston 5. The upper fluid outlet 10 has a greater distance from the top dead center 16 than does the lower fluid outlet 11 from the bottom dead center 17. For example, the distance between the upper fluid outlet 10 and its dead center 16 may be about ⅔ of the entire travel of the piston. The distance between the lower fluid outlet 11 and its dead center is smaller and is, e.g., about 2 to 10 m.

The distance between the upper fluid outlet 10 and its dead center 16 and the filling as well as the pressure of the compressed driving fluid may be coordinated with one another, such that the inner pressure in the cylinder arrangement 3 will have decreased during the downward movement of the piston 5 from its dead center to about the value of the ambient pressure when the piston 5 reaches the upper fluid outlet 10. In addition, the height and the width of the fluid outlets 10, 11 may be coordinated correspondingly. In the case of such a design, cracking noises are extensively prevented from being generated, because the fluid column present above the piston 5 no longer has a substantial overpressure compared with the environment.

At the lower end, in the foot area of the structure 14, the amusement facility 1 has a braking means 13, which can act as an emergency brake and optionally also as a service brake. The braking means 13 is preferably designed as an eddy current brake. Its design corresponds to that of the eddy current brake known from WO 96/32172 and is know to one of ordinary skill. The eddy current brake therefore does not need to be further described. It is preferably designed as a linear brake and has a preferably stationary exciter part and, relative to this, a movable conductive part arranged at the passenger carrier 2 in this case. The exciter part has a plurality of alternatingly poled magnet elements arranged in a row one on top of another and is fastened to the structure 14. The conductive part has a rail-like design and is fastened to the passenger carrier 2. It has a lining support with one or more electrically conductive lining elements. The latter may have different thickness and/or consist of different materials over the braking section. The kinematic assignment of the exciter part and conductive part may, however, also be reversed, analogously to the prior-art eddy current brakes. The eddy current brake 13 is shown in FIG. 1 only schematically.

The amusement facility 1 may also have a cable brake 15 at the top end. This can briefly hold the pulling element 6 when the passenger carrier or passenger carriers 5 is/are located at the upper zenith of its/their path of movement. As a result, the passenger carrier 2 is held briefly before it plunges downward.

FIG. 1 shows the amusement facility 1 in two operating positions. In the starting position, the passenger carrier or passenger carriers 2 is/are on the ground, while the piston 5 assumes its top dead center position 16 at the top end of the cylinder. The passenger carriers 2 and the piston 5 are shown by solid lines in this position.

The passenger carrier or passenger carriers 2 is/are in the raised position at the upper zenith of its/their path of movement in the second operating position, while the piston 5 assumes its bottom dead center 17. This operating position is indicated by broken lines.

The passenger carrier or passenger carriers 2 is/are shot upward by the cylinder arrangement 3 from the first operating position or resting position after the passengers have gotten on board. To achieve this, the compressible fluid is pressed via the upper inlet valves 9 into the cylinder or cylinders 3, while the piston 5 is forced downward and pulls the passenger carrier or passenger carriers 2 upward via the upper half of the pulling element 6. The eddy current brake 13 now exerts a damping action on the buildup of pressure in the cylinders 3. It brakes the upward movement of the passenger carrier or passenger carriers 2 and also brakes the downward movement of the piston 5 correspondingly. The inner pressure in the cylinder arrangement 3 can build up more slowly and more continuously due to this opposing force. As soon as the passenger carrier or passenger carriers 2 has/have left the eddy current brake 13, it/they is/are jerked upward with a strong impulse, because the inner pressure built up in the cylinder arrangement 3 is now able to force the piston 5 downward unhindered.

In the preferred embodiment, the admission of pressure is controlled via the inlet valves 9 such that the inner pressure in the cylinder will have dropped to about the value of the ambient pressure when the piston 5 reaches the upper fluid outlet 10. The cylinder drive will then lose its action and the passenger carrier or passenger carriers 2 will then fly upward due to its/their mass inertia. The piston 5 moving downward pushes out the fluid volume located under it during its movement first through the upper air outlet 10 and then, after passing beyond it, through the lower fluid outlet 11. As soon as the piston 5 has passed beyond the lower fluid outlet 11, it again compresses the fluid column present at the lower end of the cylinder. This acts as a pressure cushion and also brakes the upward movement of the passenger carrier or passenger carriers 2. At the end of this movement, the piston 5 and the passenger carrier 2 assume the second operating position indicated by broken lines. The cable brake 15 can also hold the arrangement briefly in this position. The lower discharge valves 18 may optionally also be ventilated briefly in order to prevent an excessively high pressure and braking effect from building up.

The passenger carrier 2 subsequently plunges, while the piston 5 is driven upward, in the opposite direction. This downward movement may be supported by the additional admission of a compressible fluid at the lower fluid inlet 9. The passenger carrier or passenger carriers 2 is/are then pulled downward by the lower half of the endless pulling element 6. A free fall effect is generated by this additional acceleration. The downward acceleration may reach, e.g., 1.5 g, absolute.

As soon as the piston 5 passes over the lower fluid outlet 11, the inner pressure in the cylinder is again reduced. A coordination of the volume of fluid introduced and of the fluid pressure may again be coordinated in order for the inner pressure to correspond essentially to the ambient pressure when the lower fluid outlet 11 is reached. The distance between the lower fluid outlet 11 and the bottom dead center 17 may be correspondingly adapted as well.

After passing beyond the lower fluid outlet 11, the passenger carrier 2 falls only under its own weight until the upper fluid outlet 10 is reached. Beginning from here, the piston 5 moving upward again compresses the fluid column present in the upper area of the cylinder. The passenger carrier or passenger carriers 2 is/are now braked during its/their downward movement until the forces are equalized. The compressed fluid column then again forces the piston 5 downward and pulls the passenger carrier or passenger carriers 2 upward. Pressure can be additionally admitted now via the upper fluid inlet 9, but this is not absolutely necessary. As soon as the piston 5 has again reached the upper fluid outlet 10, the passenger carrier or passenger carriers 2 flies/fly upward only ballistically and then returns/return. Depending on the pressure buildup in the upper part of the cylinder, the piston 5 with the passenger carrier or passenger carriers 2 swings up and down on the upper fluid column. This generates the above-mentioned bunjee effect for the passengers.

There is a certain leak in the upper and lower cable outlets 19, and the inner pressure in the upper and lower parts of the cylinder 3 is automatically released by these leaks. In addition, the discharge valves 18 can be opened and closed in a controlled manner. Furthermore, there is a control via a possible admission of pressure via the upper fluid inlets 9. The bunjee effect can be intensified and prolonged by this admission of pressure. Without the admission of pressure from the outside, the swinging movements gradually attenuate until the passenger carrier or passenger carriers 2 slowly sink to the ground.

The eddy current brake 13 may be involved in the bunjee effect. It is preferably made relatively short in order for it to be able to act as an emergency brake and to have a relatively weak effect as a service brake during pulling up. However, it may be involved for the first case from the topmost position of the passenger carrier. The pressure admitted on the underside of the cylinder via the lower fluid inlets 9 is now so high that the passenger carrier 2 is thrown downward into the eddy current brake 13 and is braked rapidly there. The braking acceleration may then reach about 2.5 g at the lower end of this falling movement. The passenger carrier 2 no longer enters the eddy current brake 13 during the subsequent bunjee swings and has lower upward and downward accelerations.

The amusement facility 1 also makes possible an adaptation to the number and weight of the passengers. This is possible, e.g., by correspondingly controlling the fluid inlets 9. The weight of the passenger carrier or passenger carriers 2 was determined in a suitable manner before. Corresponding to the weight, more or less energy is generated in the cylinder arrangement 3. The zenith of the upward movement of the passenger carrier or passenger carriers 2 can also be set and controlled via the upper air inlets 9.

To achieve maximum accelerations at the passenger carrier 2, it is recommended that the weight of the piston 5 be kept as small as possible. It is substantially lower than the intrinsic weight of the passenger carrier or passenger carriers 2.

Variants of the embodiment shown are possible in various ways. On the one hand, the design of the cylinder arrangement 3 may vary in the above-mentioned manner. The shape, design and arrangement of the piston 5 are variable as well. Instead of an upright structure 14, there may also be an oblique or horizontal position. The passenger carrier or passenger carriers 2 is/are correspondingly guided differently. As an alternative, the cylinder arrangement 3 may have only one lateral air outlet 10. However, there also may be more than two fluid outlets 10, 11. The design and the arrangement of the fluid inlets 9, of the cable outlets 19 and of the discharge valves 18 are variable as well. However, the discharge values 18 cannot be abandoned. Any desired, suitable gas or even liquid may be used as the driving fluid. Compressed air is preferably used for cost reasons. However, it may also be another fluid, which is optionally collected at the fluid outlets 10, 11 and also at the other points of discharge 18, 19 and returned.

While specific embodiments of the invention have been shown and described in detail to illustrate the application of the principles of the invention, it will be understood that the invention may be embodied otherwise without departing from such principles.

What is claimed is:

1. An amusement facility comprising:

a frame;

a passenger carrier movably mounted on said frame;

a drive means connected to said passenger carrier and for moving said passenger carrier on said frame, said drive means including a cylinder and a piston, said drive means including a tension member connecting said passenger carrier to said piston, said piston being movable in said cylinder between a top dead center position and a bottom dead center position, said cylinder including first and second ends, and including a fluid inlet and a fluid outlet for fluid to move said piston in said cylinder, said fluid outlet being positioned between said top dead center position and said bottom dead center position of said piston, said drive means includes a controllable discharge valve at one said end of said cylinder adjacent one of said dead center positions and spaced from said one dead center position;

an eddy current brake adjacent a bottom of said frame and for braking said passenger carrier as a service brake and an emergency brake.

2. An amusement facility in accordance with claim 1, wherein:

said fluid outlet is formed as a plurality of slots in said cylinder.

3. An amusement facility in accordance with claim 1, wherein:

said fluid outlet has a plurality of controllable closures.

4. An amusement facility in accordance with claim 1, wherein:

a plurality of said fluid outlets are arranged at spaced locations from one another in said cylinder.

5. An amusement facility in accordance with claim 4, wherein:

a first of said plurality of fluid outlets is spaced a greater distance from said top dead center position than a second of said plurality of fluid outlets is spaced from said bottom dead center position.

6. An amusement facility in accordance with claim 4, wherein:

a closest one of said fluid outlets to said top dead center position is approximately ⅔ of a total travel distance of said piston from said top dead center position.

7. An amusement facility in accordance with claim 4, wherein:

a closest one of said fluid outlets to said bottom dead center position is approximately 2 to 10 meters from said bottom dead center.

8. An amusement facility in accordance with claim 1, wherein:

a pressure generator means feeds said fluid inlets of said cylinder, said pressure generator includes control means for coordinating fluid flow into said cylinder with a length of a closest one of said fluid outlets to said top dead center position to cause an inner pressure in said cylinder to drop to approximately an ambient pressure when said piston reaches said closest one of said fluid outlets during downward travel.

9. An amusement facility in accordance with claim 1, wherein:

said cylinder includes a plurality of said fluid inlets;

a first of said fluid inlets is position at one of said ends of said cylinder adjacent said top dead center position and spaced from said top dead center position, a second of said fluid inlets is positioned at another of said ends of said cylinder adjacent said bottom dead center position and spaced from said bottom dead center position.

10. An amusement facility in accordance with claim 1, wherein:

said drive means includes one of said controllable discharge valves at each said end of said cylinder and spaced from an adjacent said dead center position.

11. An amusement facility in accordance with claim 1, wherein:

said tension member connects two opposite sides of said piston to two opposite sides of said passenger carrier.

12. An amusement facility in accordance with claim 1, further comprising:

a controllable cable brake for said tension member adjacent said top dead center position.

13. An amusement facility in accordance with claim 1, wherein:

said tension member is a cable arrangement, said drive means includes cable outlets at said ends of the cylinder and a deflecting roller guiding said cable arrangement.

14. An amusement facility in accordance with claim 13, wherein:

said cable outlets are formed as sound absorbers.

15. An amusement facility in accordance with claim 1, wherein:

said frame is designed as a tower-like, upright frame.

* * * * *